United States Patent [19]

Nakayama et al.

[11] Patent Number: 4,993,601

[45] Date of Patent: Feb. 19, 1991

[54] DISPENSING UNIT COMPRISING A GAS PATH IN WHICH A BEVERAGE IS EFFECTIVELY PREVENTED FROM A COUNTERFLOW THEREOF

[75] Inventors: Shunichi Nakayama, Takasaki; Yasushi Takayanagi, Akabori, both of Japan

[73] Assignee: Sanden Corporation, Gunma, Japan

[21] Appl. No.: 434,784

[22] Filed: Nov. 13, 1989

[51] Int. Cl.[5] ..... B67D 5/56

[52] U.S. Cl. ..... 222/394; 222/129.1; 222/399; 222/189; 222/400.7; 222/484

[58] Field of Search ..... 222/129.1, 129.2, 129.3, 222/129.4, 145, 189, 394, 399, 400.7, 400.8, 484

[56] References Cited

U.S. PATENT DOCUMENTS

| | | | |
|---|---|---|---|
| 2,462,019 | 2/1949 | Bowman . | |
| 3,186,599 | 6/1965 | Levinson et al. | 222/400.7 X |
| 3,200,994 | 8/1965 | Levinson et al. . | |
| 3,231,140 | 1/1966 | Krup | 222/129.2 |
| 3,240,395 | 3/1966 | Carver | 222/129.1 |
| 4,304,736 | 12/1981 | McMillin et al. . | |
| 4,493,441 | 1/1985 | Sedam et al. . | |
| 4,555,371 | 11/1985 | Jeans . | |
| 4,592,490 | 6/1986 | McMichael | 222/129.1 |
| 4,688,701 | 8/1987 | Sedam . | |
| 4,836,414 | 6/1989 | Credle, Jr. et al. | 222/400.7 X |
| 4,932,561 | 6/1990 | Boxall | 222/129.1 X |

*Primary Examiner*—Kevin P. Shaver

*Attorney, Agent, or Firm*—Banner, Birch, McKie & Beckett

[57] ABSTRACT

In a dispensing unit comprising a gas path which is for supplying gas into a bottle to thereby dispense a beverage contained in the bottle, the gas path extends along a substantial U-shape. The gas path is provided with a plurality of check valves therein in series. Each of the check valves is for preventing a counterflow of the beverage in the gas path.

7 Claims, 5 Drawing Sheets

DISPENSING UNIT COMPRISING A GAS PATH IN WHICH A BEVERAGE IS EFFECTIVELY PREVENTED FROM A COUNTERFLOW THEREOF

BACKGROUND OF THE INVENTION

This invention relates to a dispensing unit for dispensing a beverage, such as a syrup or the like, from a bottle by pressure of gas, in particular, to controlling of a flow of the gas in a gas path which is for supplying the gas into the bottle.

Various dispensing units of the type are already known. For example, a dispensing unit as a post-mixed beverage dispenser is disclosed in U.S. Pat. Nos.4,493,441 and 4,688,701 issued to Jason K. Sedam et al and assigned to The Coca-Cola Company.

Such a dispensing unit is for dispensing a beverage contained in a bottle and comprises a unit body defining a gas path which is for supplying gas, such as $CO_2$ gas, into the bottle. For preventing the beverage flow out from the bottle through the gas path, a check valve is generally provided to the gas path as well known in the art.

However, it will be assumed that the beverage flows out from the bottle through the check valve. In other words, a counterflow is caused about the beverage. This is because the gas path is very simple.

In addition, it will be assumed that the beverage adheres to the check valve to thereby obstruct predetermined operation of the check valve. This results in causing of the counterflow of the beverage.

SUMMARY OF THE INVENTION

It is therefore an object of the present invention to provide a dispensing unit in which the beverage is effectively prevented from the counterflow thereof directed from the bottle towards the gas path.

Other objects of this invention will become clear as the description proceeds.

According to this invention, there is provided a dispensing unit for dispensing a beverage contained in a bottle having an outlet portion defining a bottle opening. The dispensing unit includes a unit body having an upper surface and a side surface adjacent to the upper surface. The upper surface is for receiving the outlet portion. The unit body defines a gas path which extends between the upper and the side surfaces for supplying gas into the bottle through the bottle opening to exclude the beverage from the bottle with pressure raised in the bottle. The dispensing unit further comprises valve means coupled to the gas path for controlling a flow of the beverage in the gas path. In the dispensing unit, the gas path extends along a substantial U-shape, the valve means comprising a plurality of check valves placed in the gas path in series, each of the check valves being for checking a counterflow of the beverage in the gas path.

DESCRIPTION OF THE PREFERRED EMBODIMENT

Figure 1:
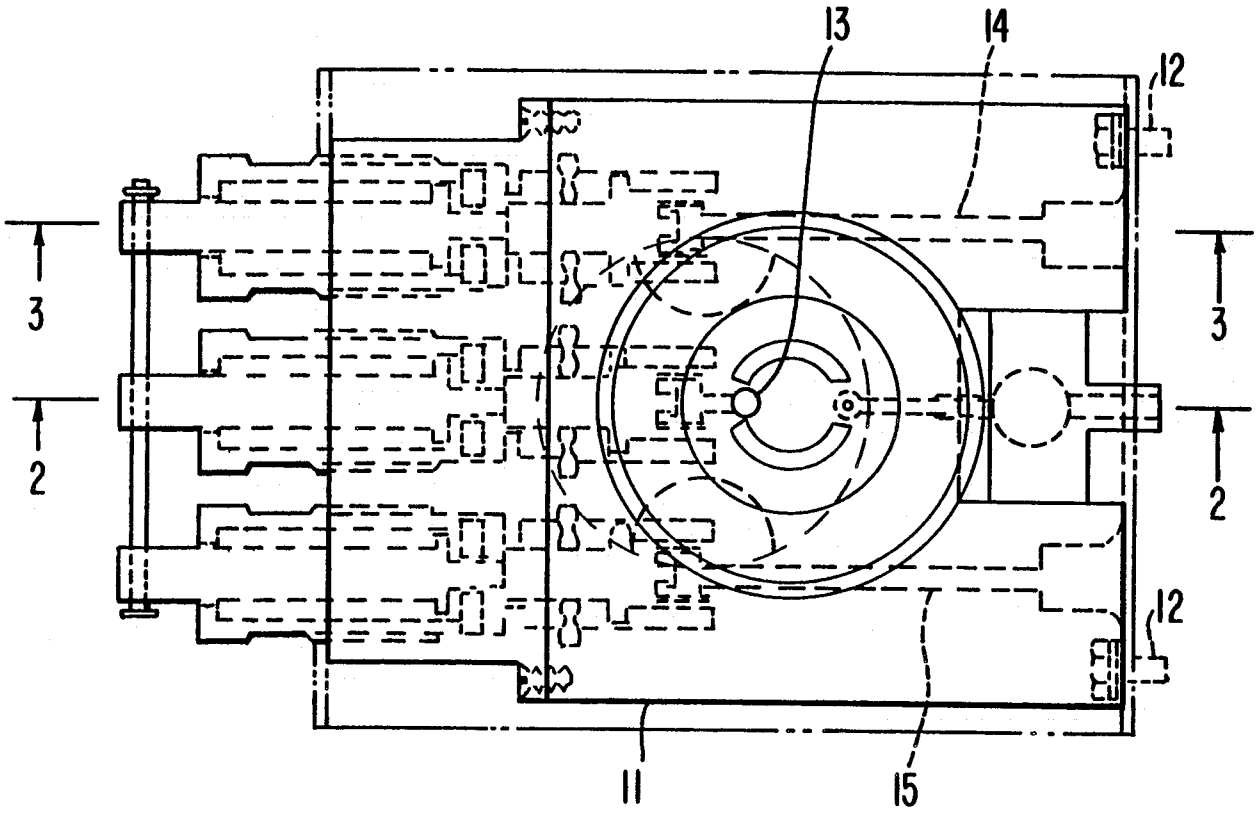
FIG. 1 is a plan view of a dispensing unit according to an embodiment of this invention.

Referring to FIGS. 1 through 4, a dispensing unit according to an embodiment of the present invention is for use in a dispensing unit which is for dispensing a beverage, such as a syrup drink diluted with dilution water and/or carbonated water in the manner known in the art. The dispensing unit comprises a body 11 which is fixed to a frame (not shown) of the dispensing unit by bolts 12 and which will be referred to as a main portion. The body 11 defines a syrup path 13 at a central position thereof and dilution water and carbonated water paths 14 and 15 which are placed at left and right sides thereof, respectively. Each of the syrup, the dilution water, and the carbonated water paths 13, 14, and 15 is referred to as a beverage path and is communicated with a nozzle 16 which is provided at a lower end of the body 11. The body 11 may be made of a combination of various parts.

The syrup path 13 has, an upper end thereof, a connecting opening 17 connected to a syrup bottle 18 which is placed on an upper surface of the body 11. The syrup bottle 18 is removable from the body 11. The bottle has an outlet portion defining a bottle opening in the manner known in the art.

The dilution water path 14 is connected to a dilution water source (not shown) through a dilution water pipe (not shown). Similarly, the carbonated water path 15 is connected to a carbonated water source (not shown). Therefore, it is possible to discharge the syrup, the dilution water, and the carbonated water through the nozzle 16.

The syrup path 13 has, between the nozzle 16 and the connecting opening 17, an intermediate portion provided with a valve mechanism 22 which is capable of opening and shutting the syrup path 13. Each of the dilution and the carbonated paths 14 and 15 is provided with another valve mechanism 23 which is similar to the valve mechanism 22.

Description will proceed to only the first-mentioned valve mechanism 22 because those valve mechanisms are similar to one another. A valve hole **11*a* is made in the body 11 to communicate with the particular portion of the syrup path 13. The valve mechanism 22 comprises valve and force transmission members 24 and 25. The valve member 24 is placed in the valve hole 11*a* to be movable in each of first and second senses 26 and 27 which are opposite to one another. The valve member 24 has a packing 28 at an end thereof in the second sense 27. The packing 28 faces the intermediate portion of the syrup path 13 and is for opening or closing the syrup path 13 with the valve member 16 moved in each of the first and the second senses 26 and 27. The valve member 24 is urged in a first sense 26 by a first compression spring 29 which is between the body 11 and the valve member 24**.

A sealing member 30 is fixed to the body 12 and is in slidable contact with the valve member 24 to seal a gap 31 left therebetween. It is to be noted in this connection that FIG. 1 illustrates a case where the valve member 24 is placed at a close position at which the syrup path 13 is closed by the valve member 24.

The valve apparatus further comprises an adjusting screw 32 of a cylindrical tube which defines a through hole 32*a*. The adjusting screw 32 is screwed in a cylindrical screw hole 11*b* which is made in the body 11 to communicate with the valve hole 11*a*. Therefore, the adjusting screw 32 has a position which is adjustable in the first and the second senses 26 and 27 by rotation thereof. In addition, it is readily possible by a small force to operate the adjusting screw 32.

The force transmission member 25 is inserted in the adjusting screw 32 and extends in the first and the second senses 26 and 27 to have first and second ends 25*a* and 25*b* which extend outside of the adjusting screw 32 in the first and the second senses 26 and 27.

A second compression spring 33 is placed inside the adjusting screw 21 and is referred to as urging arrangement. The second compression spring 33 is for urging the force transmission member 25 in the second sense 27. As a result, the first end 25*a* of the force transmission member 25 is brought in press contact with the valve member 24 to push the valve member 24 towards the close position. In this connection, the second compression spring 33 has urging force which is greater than that of the first compression spring 29. Therefore, the valve member 24 is placed at an open position to open the syrup path 13 when the force transmission member 25 is not received with external force.

A stopper 34 is fixed to an axial end of the adjusting screw 32 to be movable in each of the first and the second senses 26 and 27 dependent on the adjusting screw 32. The stopper 34 is for determining the open position. At the open position, the valve member 24 is in engagement with the stopper 34 in the first sense 26. In this connection, it is a matter of course that the valve member 24 opens the syrup path 13. The open position can be moved in each of the first and the second senses 26 and 27 by rotating the adjusting screw 32. Therefore, it is possible to adjust an opening of the syrup path 13 into a desired value thereof.

The body 11 is provided with an operating lever 35 at a front surface thereof. The operating lever 35 has a middle portion rotatably supported to a supporting portion 36 through a horizontal shaft 37. A substantial end portion of the operating lever 35 is in removable engagement with a shaft 38 which is supported to the second end 25*b* of the force transmission member 25.

When the operating lever 35 is pushed as depicted at an arrow 39, the force transmission member 17 is moved in the first sense 26. In response, the valve member 24 is also moved in the first sense to open the syrup path 13. As a result, the syrup flows from the syrup bottle 18 into the syrup path 13 and then is supplied to the nozzle 16 through the water conduction member 41. In this event, movement of the operating lever 35 is detected with a detection switch 42 operated by an arm 43 which is fixed to the operating lever 35.

Although detailed description is omitted for simplification of the description, each of the dilution water and the carbonated water paths 14 and 15 comprises constitution which is similar to that of the syrup path 13. Therefore, it is possible to supply the beverage of suitable mixing among the syrup, the carbonated water, and the dilution water through the nozzle 6. It is a matter of course that concentration of the beverage may be adjusted by each adjusting screw 32.

The syrup bottle 18 is of a cassette type which is detachably attached to the body 11. $CO_2$ gas can be supplied to the syrup bottle 18 through a gas path 44 and a gas tube (not shown) connected to the gas path 44. The gas path 44 is connected to a check unit 50 which will presently be described.

The check unit 50 comprises a casing 51 fixed to the body 11 by screw members 52. The casing 51 defines a space portion 53 which extends upwardly and downwardly as a first local portion. The space portion 53 has an upper opening and a lower opening 53*a* which is closed by a cover member 54 screwed in the lower opening. A combination of the casing 51 and the cover member 54 will be referred to as a supplementary portion. A combination of the main and the supplementary portions is referred to as a unit body.

The upper opening of the space portion 53 is connected to an inlet port 56 which is for being connected to the gas tube. The space portion 53 has a lower portion communicated with the syrup bottle 18 through the gas path 44. As a result, a combination of the gas path 44 and the space portion 53 is referred to also as a gas path which is formed in a U-shape as will become clear from FIG. 2.

The check unit 50 further comprises first and second check valves 61 and 62 which are arranged in series in the space portion of the unit body 51. The first check valve 61 is placed at a high position. The second check valve 62 is placed at a low position which is lower than the high position. A combination of the first and the second check valves 61 and 62 will be referred to as a valve arrangement.

The first check valve 61 comprises valve seat and valve body members 63 and 64 which are placed in the space portion 53. The valve seat member 63 is fixed to the casing 51. The valve body member 64 is held in a central portion of the valve seat member 63. A seal ring 65 is for sealing a clearance around the valve seat member 63.

The valve seat member 63 has a plurality of small through holes 66 which are arranged along a circle. Each of the small through holes 66 is for permitting the $CO_2$ gas pass therethrough. On the other hand, the valve body member 64 is of rubber and comprises a flange portion 67 which is placed under the valve seat member 63 to face the small through holes 66. When the valve body member is moved upwardly, the flange portion 67 becomes in contact with the valve seat member 63 to thereby check an upward flow of the $CO_2$ gas. It is a matter of course that the first check valve 61 permits the $CO_2$ gas flow downwardly.

Although detailed description is omitted for simplification of the description, the second check valve 62 comprises structure which is similar to that of the first check valve 61. A numeral 68 is representative of a filter which is well known in the art.

With this structure, a counterflow of the syrup is surely prevented by the first and the second check valves 61 and 62.

Figure 2:
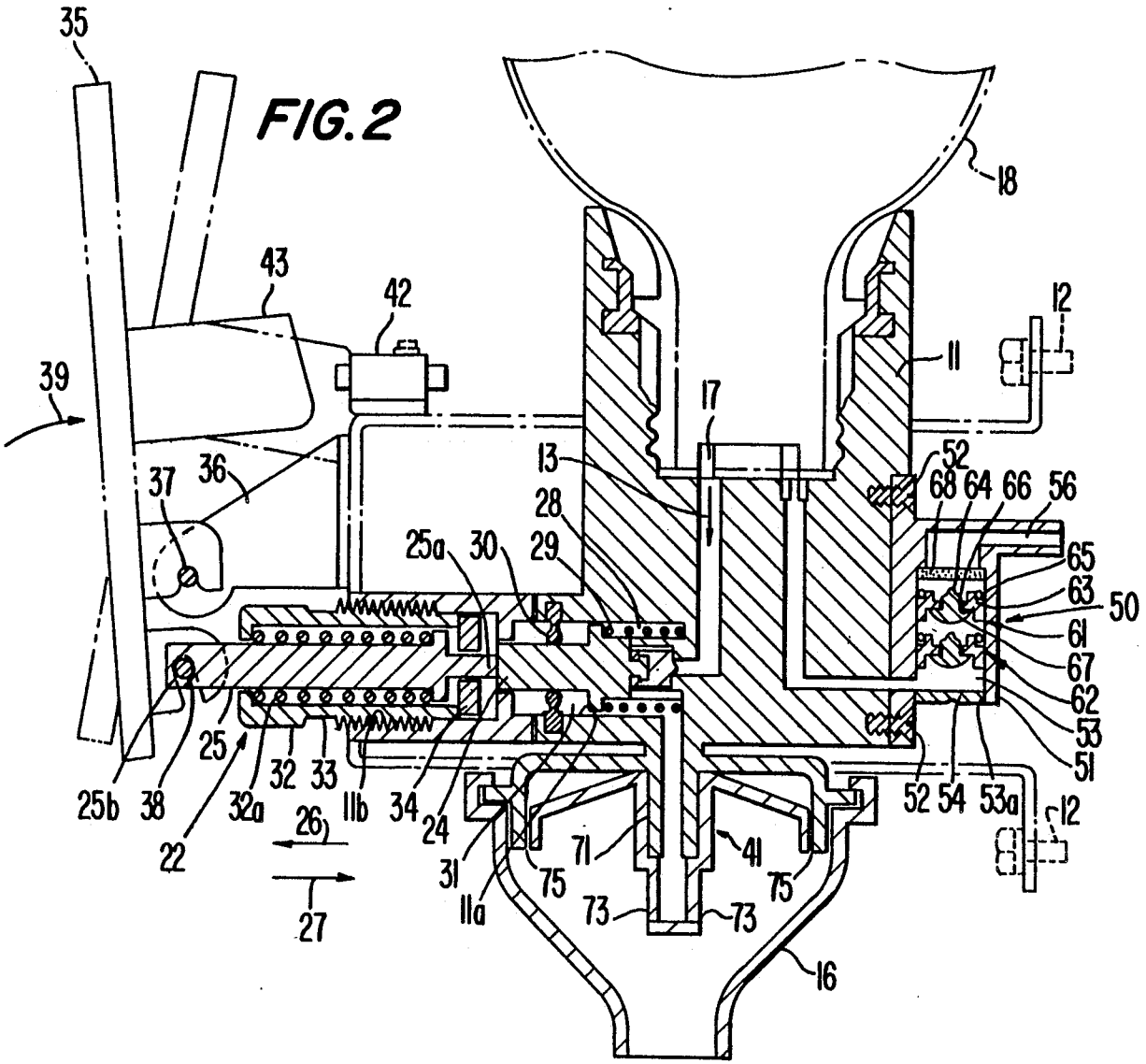
FIG. 2 is a sectional view of the dispensing unit taken along a line 2—2 in FIG. 1.
Figure 3:
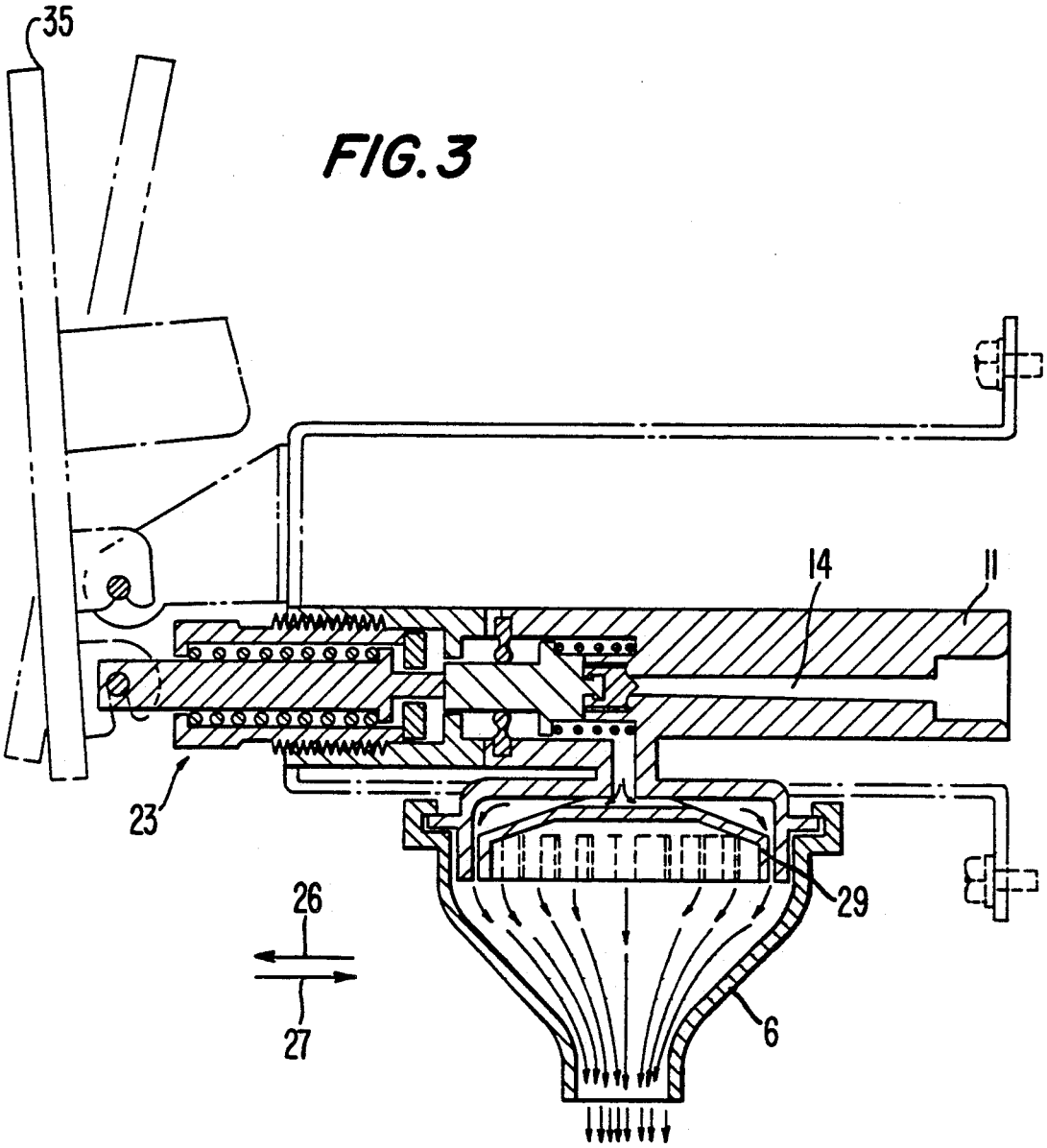
FIG. 3 is a sectional view of a part of the dispensing unit taken along a line 3—3 in FIG. 1.
Figure 5:
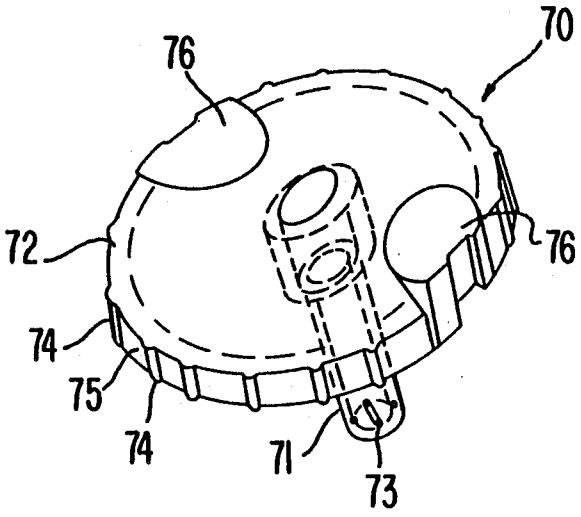
FIG. 5 is a perspective view of a water conduction member included in the dispensing unit of FIG. 1.
Figure 4:
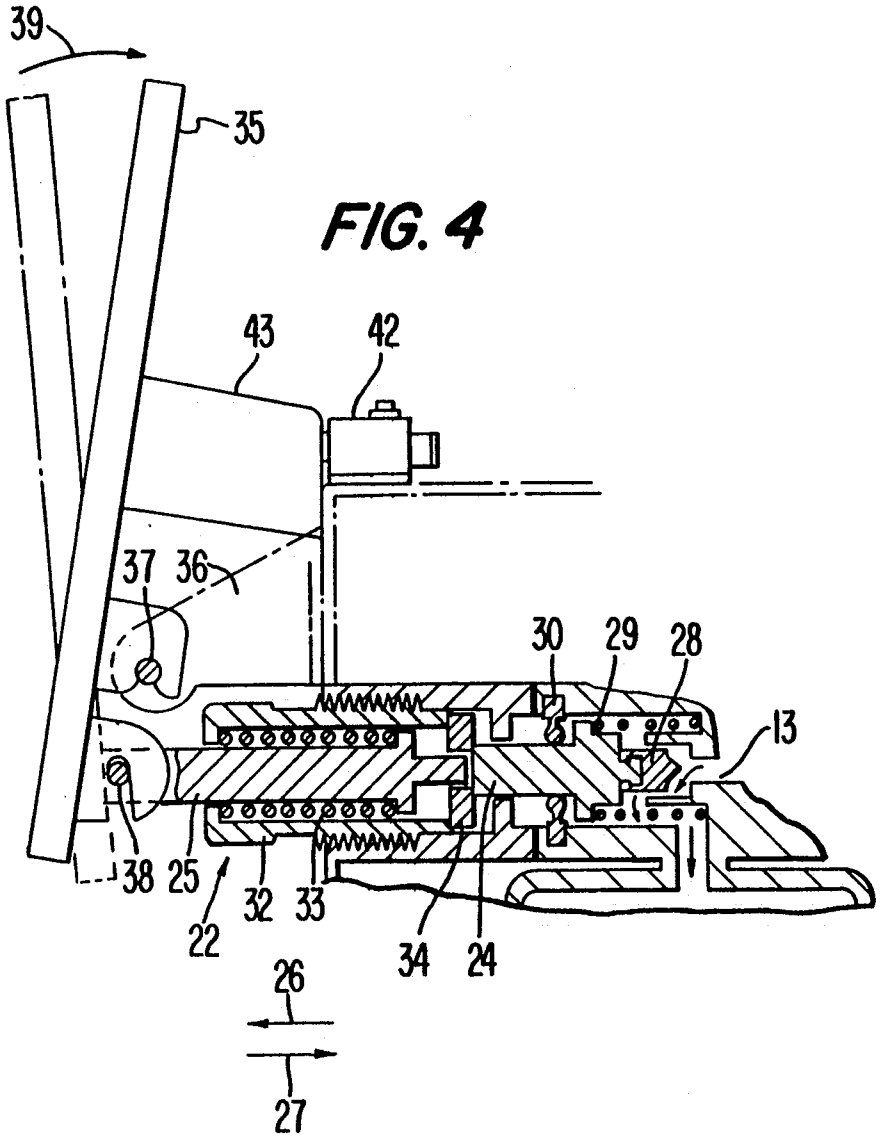
FIG. 4 is a sectional view for use in describing operation of the dispensing unit illustrated in FIG. 1.

Referring to FIG. 5 together with FIGS. 2 and 3, the water conduction member 70 comprises a cylindrical portion 71 of a central portion thereof, and a plate portion 72 which outwardly extends from an end of the cylindrical portion 71. The cylindrical portion 71 is communicated with the syrup path 13 and defines a plurality of discharging ports 73 which are radially directed at vicinity of a lower end thereof. Therefore, the syrup is discharged inside the nozzle 16 through each of the discharging ports 73.

The plate portion 72 has a plurality of projections 74 formed on a peripheral surface thereof. Two adjacent ones of the projections 74 produce a groove 75 therebetween. The plate portion 72 comprises two table portions 76 which are placed at an upper surface thereof with an angular space left therebetween. Each of the table portions 76 has an upper surface which is flat.

The water conduction member 41 is fixedly placed in the nozzle 16 so that the table portions 76 face outlet ends of the dilution and the carbonated paths 14 and 15, respectively.

When the dilution and the carbonated water are discharged from the outlet ends of the dilution water and the carbonated water paths, they collides with the upper surfaces of the table portions 76 to thereby be spread in various directions. After that, the dilution and the carbonated water are discharged inside the nozzle 16 through the grooves 75. As a result, the syrup is enveloped in the dilution and the carbonated water in the nozzle 16. Therefore, mixing are favorably carried out among the syrup, the dilution water, and the carbonated water.

Figure 6:
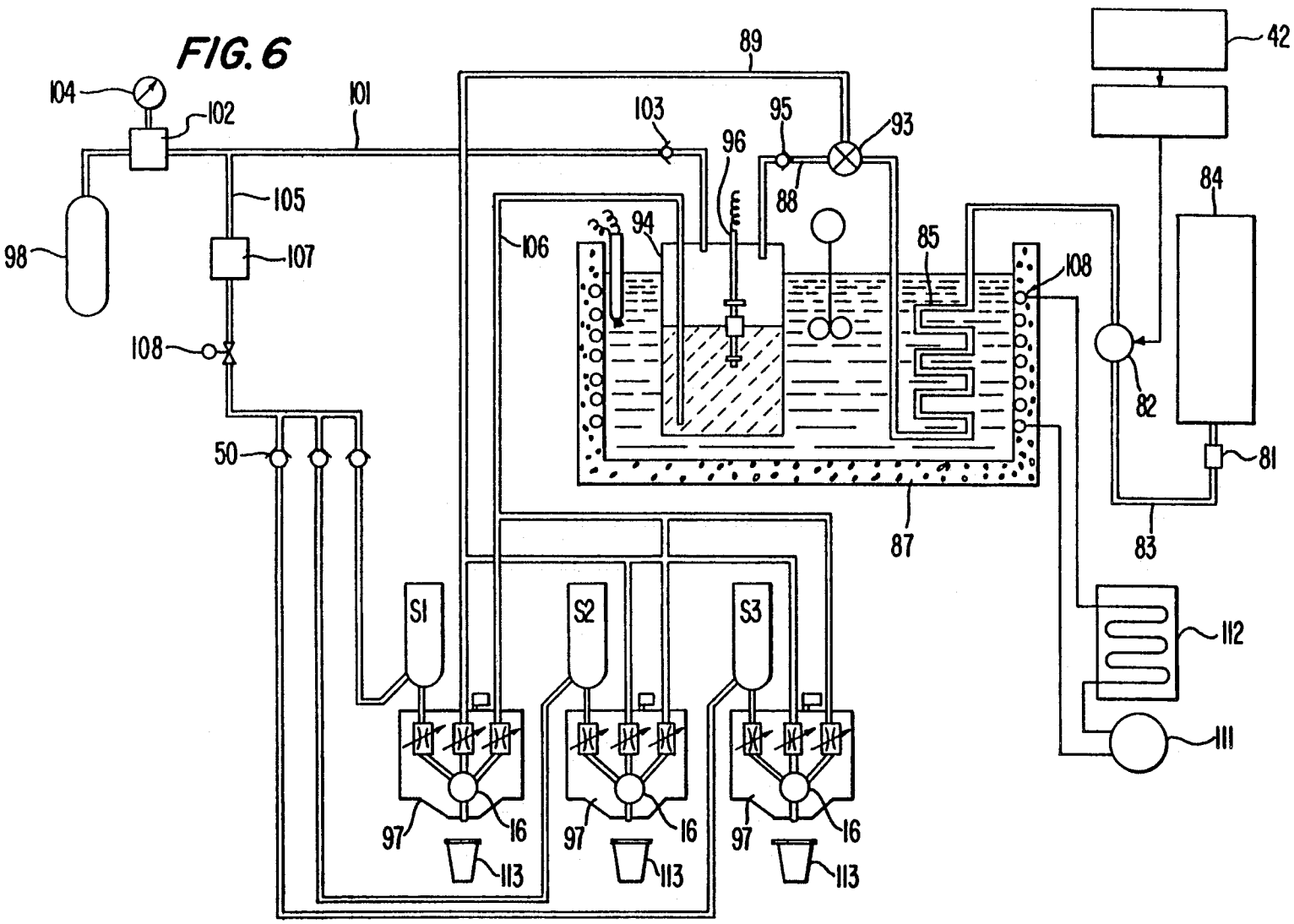
FIG. 6 is a view for use in describing a dispensing unit comprising the valve apparatus illustrated in FIG. 1.

Attention will be directed to the dispensing unit referring to FIG. 6. The dispensing unit comprises a coupler 81 connected to a pump 82 through a first supplying pipe 83. The coupler 81 is for removably connecting a portable tank 84 to the supplying pipe 83 and has a function in which the supplying pipe 83 is closed when the portable tank 84 is removed from the coupler 81. The portable tank 84 is for containing a drinking water.

The pump 82 is connected to an end of a refrigerant pipe 85 and has operation which is controlled by a control unit 86 with reference to operation of the detection switch 42. The refrigerant pipe 85 is passed through a refrigerant water contained in a refrigerant water tank 87. Second and third supplying pipes 88 and 89 are connected to another end of the refrigerant pipe 85 through an electromagnetic three-way-valve 93 which is well known in the art. The second supplying pipe 88 is connected to a carbonator 94 through a check valve 95. The carbonator 94 is provided with a flat switch 96 therein.

The dispensing unit further comprises three valve apparatus 97 which are similar to the above-mentioned valve apparatus shown in FIGS. 1 through 4. The third supplying pipe 89 is connected to the dilution water path 14 (FIG. 3) of each of the valve apparatus 97. More particularly, the third supplying pipe 89 is branched into a plurality of pipe portions which are connected to the valve apparatus 97, respectively.

A $CO_2$ tank 98 is connected to the carbonator 94 through a gas pipe 101. The carbonated water is produced from a drinking water and the $CO_2$ gas in the carbonator 94. The gas pipe 101 is provided with reducing and check valves 102 and 103 which are inserted thereto. The reducing valve 102 is provided with an indicator 104 which is for indicating a primary pressure of the gas pipe 101. The reducing valve 102 is for reducing a pressure of the $CO_2$ gas into 0.4 kg/cm$^2$.

A branched pipe 105 is connected to the gas pipe 101 between the reducing and the check valves 102 and 103. The branched pipe 105 extends through the reducing valve 107 and an operating cock 108 and is branched into a plurality of pipe portions which are connected to syrup tanks S1, S2, and S3, respectively. Each of the syrup tanks S1, S2, and S3 corresponds to the above-mentioned syrup bottle 18 shown in FIG. 2. The syrup tanks S1, S2, and S3 are connected to the valve apparatus 97, respectively.

The carbonated water can be took out from the carbonator 94 through the pipe 106. The pipe 106 is branched into a plurality of pipe portions which are connected to the carbonated water paths of the valve apparatus 97, respectively.

The refrigerant water tank 87 is provided with an evaporator 108 which extends along an internal surface thereof. As will be known in the art, the evaporator 108 is included in a refrigerant circuit which comprises a compressor 111 and a condenser 112. In this connection, the refrigerant water has a temperature which is controlled in the refrigerant water tank 87 to be about 0° C.

Description will be made about operation of the dispensing unit. When predetermined operation is carried out after a cup 113 is placed on a tray (not shown), the detection switch 42 is operated to thereby actuate both of the pump 82 and the three-way-valve 93. The pump 82 supplies the drinking water to the carbonator 94 and the valve apparatus 97. Responsive to supplying of the drinking water, the carbonator 94 produces the carbonated water to thereby supply the carbonated water to the valve apparatus 97. As a result, the drinking water, the carbonated water, and the syrup are supplied to the valve apparatus.

When the float switch 113 detects a decreasing of a water level in the carbonator 94, the pump 82 is driven to supply the drinking water into the carbonator 94. In this event, the three-way-valve 93 is not driven.

While the present invention has thus far been described in connection with only one embodiment thereof, it will readily be possible for those skilled in the art to put this invention into practice in various other manners. For example, the valve arrangement may comprise three or more than four check valves.

What is claimed is:

1. In a dispensing unit for dispensing a syrup contained in a bottle having an outlet portion defining a bottle opening, including a unit body having an upper surface and a side surface adjacent to said upper surface, said upper surface being for receiving said outlet portion, said unit body defining a gas path which extends between said upper and said side surfaces for supplying gas into said bottle through said bottle opening to exclude said syrup from said bottle with pressure raised in said bottle, said dispensing unit further comprising valve means coupled to said gas path for controlling a flow of said syrup in said gas path, the improvement wherein said gas path extends along a substantial U-shape, said valve means comprising a plurality of check valves placed in said gas path in series, each of said check valves being for preventing a counterflow of said syrup in said gas path.

2. A dispensing unit as claimed in claim 1, said gas path comprising an inlet portion at said side surface of the unit body, wherein said gas path further comprises:

a first local portion extending downwardly from said inlet portion and terminating at a lower end thereof as a first end;

a second local portion extending downwardly from said upper surface of the unit body and terminating at a lower end thereof as a second end; and a third local portion connected between said first and said second ends to make said first and said second local portions communicate with each other.

3. A dispensing unit as claimed in claim 2, wherein each of said check valves is placed in said first local portion of the gas path.

4. A dispensing unit as claimed in claim 3, wherein each of said check valves comprises:

a valve seat member fixedly placed in said first local portion of the gas path and defining a plurality of small through holes extending upwardly and downwardly; and a valve body member placed under said valve seat member in said first local portion of the gas path and movable along said first local portion for closing said small through holes when said valve body member is moved upwardly.

5. A dispensing unit as claimed in claim 2, wherein said unit body further comprises a main portion and a supplementary portion fixed to said main portion, said main portion defining said second and said third local portions of said gas path, said supplementary portion defining said first and said inlet portions of 6. A dispensing unit as claimed in claim 5, wherein said supplementary portion comprises:

a casing having a bottom portion defining a bottom opening; and a cover member attached to said bottom portion for closing said bottom opening, said cover member being removable from said bottom portion.

7. A dispensing unit as claimed in claim 2, further comprising a filter member fixedly placed in said first local portion.

* * * * *

UNITED STATES PATENT AND TRADEMARK OFFICE

CERTIFICATE OF CORRECTION

PATENT NO. : 4,993,601

DATED : February 19, 1991

INVENTOR(S) : SHUNICHI NAKAYAMA ET AL.

It is certified that error appears in the above-identified patent and that said Letters Patent is hereby corrected as shown below:

On the title page, please insert the following priority information:

-- [30] Foreign Application Priority Data
Nov. 10, 1988 [JP] Japan . . . . . .63-282480 --

Signed and Sealed this

Twenty-seventh Day of October, 1992

*Attest:*

DOUGLAS B. COMER

*Attesting Officer*

*Acting Commissioner of Patents and Trademarks*